US008574805B2

(12) United States Patent
Terui et al.

(10) Patent No.: US 8,574,805 B2
(45) Date of Patent: Nov. 5, 2013

(54) TONER

(75) Inventors: Yuhei Terui, Numazu (JP); Katsuyuki Nonaka, Mishima (JP); Koji Abe, Numazu (JP); Yasuhiro Hashimoto, Mishima (JP); Naoya Isono, Suntou-gun (JP); Akira Sugiyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 349 days.

(21) Appl. No.: 12/909,398

(22) Filed: Oct. 21, 2010

(65) Prior Publication Data

US 2011/0097657 A1 Apr. 28, 2011

(30) Foreign Application Priority Data

Oct. 27, 2009 (JP) ..... PCT/JP2009/068436

(51) Int. Cl.
*G03G 9/08* (2006.01)

(52) U.S. Cl.
USPC ..... 430/111.4

(58) Field of Classification Search
USPC ..... 430/111.4
See application file for complete search history.

(56) References Cited

U.S. PATENT DOCUMENTS 7,072,782 B2 * 7/2006 Matsuo et al. ..... 702/65

FOREIGN PATENT DOCUMENTS

| | | | |
|---|---|---|---|
| JP | 4-146448 | A | 5/1992 |
| JP | 8-62885 | A | 3/1996 |
| JP | 2003-255586 | A | 9/2003 |
| JP | 2004-279434 | A | 10/2004 |
| JP | 2004-301990 | A | 10/2004 |
| JP | 2005-17991 | A | 1/2005 |
| JP | 2005-345975 | A | 12/2005 |
| JP | 2006-317744 | A | 11/2006 |
| JP | 2008-145733 | A | 6/2008 |
| JP | 2008-164947 | A | 7/2008 |

OTHER PUBLICATIONS

Machine Translation of JP 2008-164947.*

* cited by examiner

*Primary Examiner* — Jonathan Jelsma
(74) *Attorney, Agent, or Firm* — Canon U.S.A., Inc., IP Division

(57) ABSTRACT

An object of the present invention is to provide a toner in which the problems in the techniques described are solved. That is, the object is to provide a toner which has an excellent charging characteristic regardless of the environment and which achieves high image quality over a long period of time. A toner includes toner particles including at least a binder resin, a colorant, and a wax, and at least one inorganic fine powder, the toner being characterized in that, in a thermally stimulated current spectrum of the toner measured with a thermally stimulated current measurement apparatus, the thermally stimulated current spectrum of the toner has a specific shape.

3 Claims, 4 Drawing Sheets

TONER

TECHNICAL FIELD

The present invention relates to a toner used in electrophotography, electrostatic recording, and magnetic recording. More particularly, the invention relates to a toner for electrostatic image development (hereinafter abbreviated as a "toner") used in an image recorder which can be applied to a copier, a printer, a facsimile, a plotter, or the like.

BACKGROUND ART

User requirements for electrophotographic techniques used in copiers, printers, facsimile receiving devices, and the like are becoming more and more demanding year by year as devices develop further. According to recent trends, it has become essential that high-speed printing of many sheets is possible, and that high image quality can be maintained regardless of the environment because the use environment has become diversified with the expansion of the market.

In order to satisfy the requirements described above, toners having high durability and high stability have been needed more than ever, and various studies have been conducted. For example, as a method for evaluating the chargeability of toner, measurement of a thermally stimulated current has been disclosed (for example, refer to Patent Literature 1). Furthermore, it has been disclosed that, when the thermally stimulated current has a specific value, a toner having a good charging characteristic can be provided (for example, refer to Patent Literature 2 to Patent Literature 5).

In each of Patent Literature 2 and Patent Literature 3, by defining first and second thermally stimulated current values in specific temperature ranges, the existential state of a wax on the toner surface is estimated. This makes it possible to obtain a toner having an excellent charging characteristic, thus realizing high image quality regardless of the environment.

Patent Literature 4 discloses a technique in which a thermally stimulated current in a toner has two or more peaks in a specific range, and on the basis of the relationship between the peak values, a toner having good rise of charging and good retentivity of charge is obtained. In this way, even in a state of being left to stand for a long period of time, it is possible to immediately obtain a sufficient charge amount, which makes it possible to shorten the start-up time.

Patent Literature 5 discloses that it is possible to provide a toner having high durability and high charge stability on the basis of the temperature at which a thermally stimulated current is generated in a toner and hardness of toner.

In each of the patent literatures described above, the charging characteristic is defined on the basis of the peak current value at a certain temperature in the measurement of a thermally stimulated current in the toner. However, in such a definition, the charging characteristic of toner under various environments, such as under a high-temperature, high-humidity environment and under a low-temperature, low-humidity environment, is not defined. Therefore, in the toners described in the patent literatures described above, there is still room for improvement in terms of retention of charge under a high-temperature, high-humidity environment and inhibition of excessive charging under a low-temperature, low-humidity environment.

CITATION LIST

Patent Literature

PTL 1 Japanese Patent Laid-Open No. 8-62885
PTL 2 Japanese Patent Laid-Open No. 2008-164947

PTL 3 Japanese Patent Laid-Open No. 2008-145733
PTL 4 Japanese Patent Laid-Open No. 2006-317744
PTL 5 Japanese Patent Laid-Open No. 2004-301990

An object of the present invention is to provide a toner in which the problems in the techniques described are solved. That is, the object is to provide a toner which has an excellent charging characteristic regardless of the environment and which achieves high image quality over a long period of time.

SUMMARY OF INVENTION

The present invention relates to a toner including toner particles including a binder resin, a colorant, and a wax, the toner being characterized in that, in a thermally stimulated current spectrum measured with a thermally stimulated current measurement apparatus, the difference T0−T1 is 7.5° C. or more and 30.0° C. or less, and the difference T2−T0 is more than 0° C. and 15.0° C. or less, where T0 (° C.) is the temperature at MP which is a minimum value appearing on the highest temperature side among minimum values at a current value in a range of $-1.0\times10^{-13}$ A to $-1.0\times10^{-14}$ A, T1 (° C.) is the temperature at which the current value is a quarter of MP and which is closest to T0 on the low temperature side, and T2 (° C.) is the temperature at which the current value is a quarter of MP and which is closest to T0 on the high temperature side.

Further features of the present invention will become apparent from the following description of exemplary embodiments with reference to the attached drawings.

DESCRIPTION OF EMBODIMENTS

It is an essential task to provide a toner having an excellent charging characteristic in order to achieve high image quality over a long period of time regardless of the environment and also in order to satisfy the market need.

The present inventors have found that the charging characteristic of a toner has strong relationship with a thermally stimulated current spectrum, and by defining the thermally stimulated current spectrum, it is possible to obtain a toner that satisfies the task. Here, the phrase "thermally stimulated current" refers to a current that flows when a toner charged by corona charging is subjected to a change in temperature, and is measured with a thermally stimulated current measurement apparatus. The change in the thermally stimulated current value due to an increase in temperature is referred to as a "thermally stimulated current spectrum". The thermally stimulated current is commonly used as means for evaluating chargeability of toner. For example, *Advanced Technologies in Toner Based Printing Materials and Processes* (published by CMC Publishing Co., Ltd.; Aug. 31, 2005; first printing) includes a chapter on thermally stimulated current of toner and describes that the depth of charge-trapping levels can be determined by the thermally stimulated current (refer to ibidem, p. 329).

Figure 1:
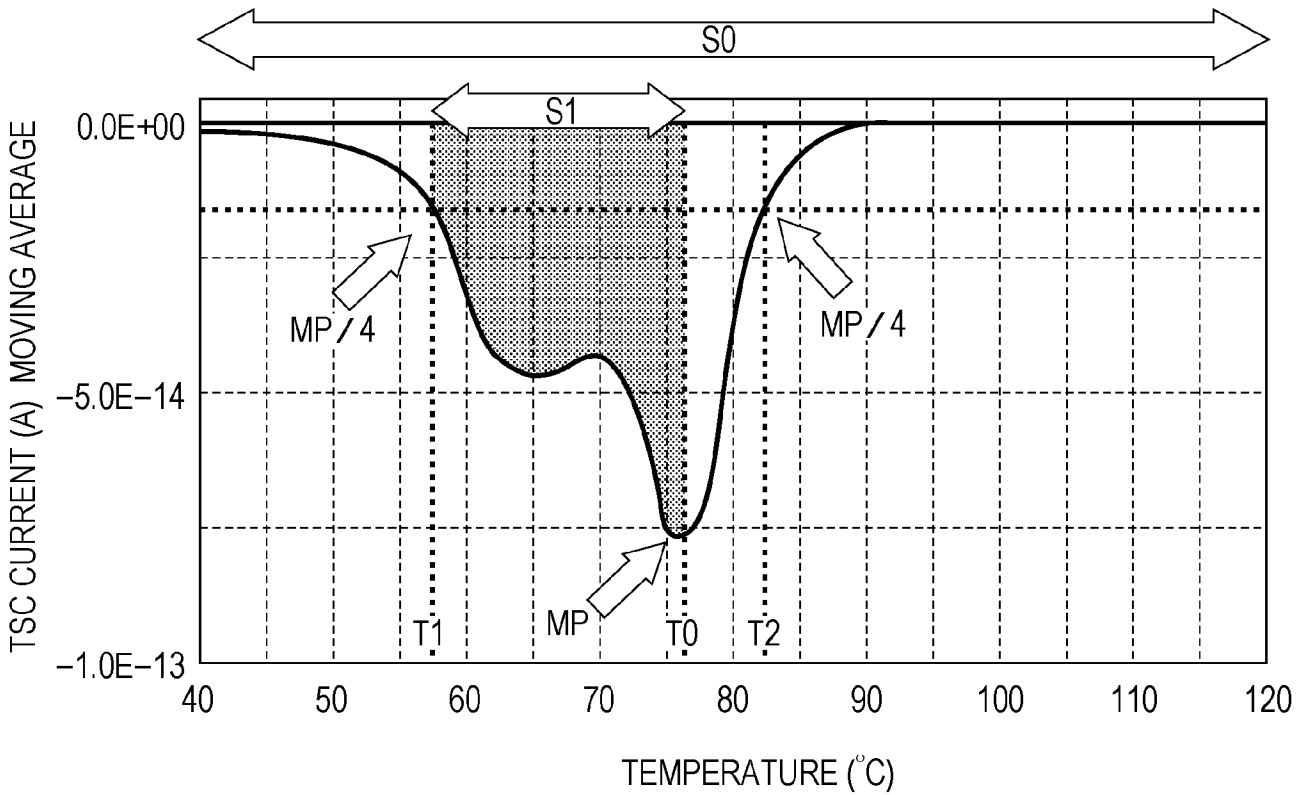
FIG. 1 is a graph showing an example of a thermally stimulated current spectrum of a toner of the present invention.

FIG. 1 shows an example of a thermally stimulated current spectrum of a toner of the present invention. The vertical axis represents the current value and shows the amount of charge moving with respect to temperature. The influence of such a thermally stimulated current spectrum on the charging characteristic of the toner is considered by the present inventors to be as follows.

In the thermally stimulated current spectrum, the current value represents the state of charges possessed by the toner when charged. That is, charging of toner or discharging of charges from the toner can be caused by application of energy from the outside. Consequently, charge transfer occurs when a temperature corresponding to the energy is applied, and at this time, a thermally stimulated current is generated.

Furthermore, in one toner particle, there are both weakly charged parts and strongly charged parts. This is reflected in the thermally stimulated current spectrum. That is, in the thermally stimulated current spectrum, the thermally stimulated current generated on the low-temperature side is due to charges of weakly charged parts, which relatively easily move even at low energy. Such weakly charged parts greatly influence the rise characteristic of charging of toner, but easily cause leakage, thus degrading charging stability of toner. In contrast, the thermally stimulated current generated on the high temperature side is due to charges of strongly charged parts, in which high energy is required to move charges. Such strongly charged parts contribute to stable charging of toner. However, since charges are not easily discharged, excessive charging easily occurs, which may result in image defects.

In the toner of the present invention, as shown in FIG. 1, the thermally stimulated current is generated broadly on the low temperature side. In the toner having such a peak, excessive charging does not occur, and the charging state is stable. The toner exhibits excellent chargeability without being easily influenced by the environment. The reason for this is believed to be as follows.

That is, in the toner described above, moderately charged parts are adequately present, and charges are allowed to transition. Thereby, weakly charged parts are immediately charged, and charges move through moderately charged parts to strongly charged parts. As a result, the toner has a quick rise of charging, and a stable charging state can be obtained. Furthermore, when the amount of charges of strongly charged parts increases, excess charges move through moderately charged parts to weakly charged parts. Thereby, charges leak so that the toner is prevented from being excessively charged.

For the reason described above, the present inventors have specified the toner of the present invention as described below. That is, it has been found to be essential for solving the problem that, in a thermally stimulated current spectrum measured with a thermally stimulated current measurement apparatus, the difference T0−T1 is 7.5° C. or more and 30.0° C. or less, and the difference T2−T0 is more than 0° C. and 15.0° C. or less, where T0 (° C.) is the temperature at MP which is a minimum value appearing on the highest temperature side among minimum values at a current value in a range of $-1.0\times10^{-13}$ A to $-1.0\times10^{-14}$ A, T1 (° C.) is the temperature at which the current value is a quarter of MP and which is closest to T0 on the low temperature side, and T2 (° C.) is the temperature at which the current value is a quarter of MP and which is closest to T0 on the high temperature side. Thus, the present invention has been completed.

Note that the reason for defining T1 as the temperature at which the current value is a quarter of MP and which is closest to T0 on the low temperature side from the minimum value MP and for defining T2 as the temperature at which the current value is a quarter of MP and which is closest to T0 on the high temperature side from the minimum value MP is as follows. In a thermally stimulated current spectrum, a portion where the current value is less than a quarter of the minimum value does not substantially contribute to the charging characteristic of toner. Consequently, in order to specify a portion where the current value is a quarter or more of MP, T1 and T2 are defined as described above.

When the difference T0−T1 is 7.5° C. or more and 30.0° C. or less, the thermally stimulated current spectrum sufficiently broadens toward the low temperature side. Since charges move smoothly, immediate charging is possible. Furthermore, since the number of moderately charged parts increases, stable chargeability is obtained.

The difference T0−T1 is preferably 13.0° C. or more and 25.0° C. or less, and more preferably 13.0° C. or more and 20.0° C. or less. When the difference T0−T1 is in this range, a better charging characteristic of toner can be stably obtained over a long period of time.

When the difference T0−T1 is less than 7.5° C., the thermally stimulated current spectrum does not sufficiently broaden toward the low temperature side. Therefore, in particular, under a high-temperature, high-humidity environment, the rise of charging is poor, and fogging occurs in the initial image under a high-temperature, high-humidity environment. Furthermore, when printing is repeated over a long period of time under a low-temperature, low-humidity environment, excessive charging causes contamination of components, resulting in occurrence of development streaks.

When the difference T0−T1 exceeds 30.0° C., since the thermally stimulated current spectrum broadens excessively toward the low temperature side, charges move quickly, and it takes a long time to transition to a stable state. Therefore, the rise of charging is delayed by leakage of charges, and the total charge amount as a whole becomes insufficient, thus degrading development performance. As a result, the insufficient charge amount of toner causes degradation in developing stability, such as a decrease in image density due to degradation in transferability, or a decrease in fogging under a high-temperature, high-humidity environment.

Furthermore, it is necessary that the difference T2−T0 should be more than 0° C. and 15.0° C. or less. The thermally stimulated current spectrum on the high temperature side from the minimum value indicates stable charges possessed by the charged toner. However, when the spectrum broadens toward the high temperature side from the minimum value, the state of charges possessed by the toner does not easily transition, and excessive charging easily occurs. Consequently, when the difference T2−T0 exceeds 15.0° C., even in the range of the difference T0−T1 described above, the number of charges excessively charged increases, and contamination of components, such as a toner supporting member, easily occurs. As a result, filming easily occurs.

Furthermore, the difference T2−T0 is preferably 5.0° C. or less. In this range, stable, high image quality is obtained even in the case where continuous printing is performed over a long period of time.

Furthermore, in the present invention, it is necessary that the minimum value MP should be $-1.0\times10^{-13}$ A or more and $-1.0\times10^{-14}$ A or less. The magnitude of MP roughly represents the amount of charges possessed by the toner. Accordingly, when MP exceeds $-1.0\times10^{-14}$ A, the charge amount of the toner becomes insufficient, and development performance is markedly degraded. As a result, transferability may degrade, or image density stability may decrease. Furthermore, fogging becomes worse. On the other hand, when MP is less than $-1.0\times10^{-13}$ A, the toner, as a whole, tends to be excessively charged, resulting in marked contamination of components under a low-temperature, low-humidity environment, and extreme deterioration of filming and development streaks is observed. The minimum value MP is preferably $-1.0\times10^{-13}$ A or more and $-3.0\times10^{-14}$ A or less. In this range, since a sufficient charge amount can be retained, even in the case where printing is performed over a long period of time, performance can be maintained in terms of development performance and fogging.

Furthermore, T0 is preferably 65° C. or more and 110° C. or less. When T0 is in this range, the state of charges is stable, and it is possible to effectively prevent degradation of development performance, and fogging or the like. Furthermore, in FIG. 1, the ratio of S1 to S0, i.e., S1/S0, is preferably 0.35 or more and 0.85 or less, where S0 is the area of the thermally stimulated current spectrum in the range of 40° C. to 120° C., and S1 is the area in the range of the temperature T1 to the temperature T0. The S1/S0 indicates the degree of contribution of broadening of the thermally stimulated current spectrum toward the low temperature side to the entire thermally stimulated current. When S1/S0 is in the range described above, it is possible to effectively suppress contamination of components due to excessive charging of toner and fogging due to a decrease in the charge amount.

Furthermore, S1/S0 is more preferably 0.60 or more and 0.75 or less. In addition, preferably, the difference T0−T1 is larger than the difference T2−T0. When the difference T0−T1 and the difference T2−T0 have such a relationship, it is possible to effectively suppress excessive charging of toner.

A method of measuring the thermally stimulated current spectrum will be described below.

<Method of Measuring Thermally Stimulated Current Spectrum>

In the present invention, a thermally stimulated current (TSC) is measured by a method in which, by applying an electric field to a sample, polarization or charge trapping is generated inside the sample, and a current generated by a decrease in depolarization mainly in the temperature rising process is detected. As a measurement apparatus, an electron trap measurement system (TS-FETT: manufactured by Rigaku Corporation) can be used. A specific measurement method is described in the TS-FETT operation manual (May 2005 edition) published by Rigaku Corporation. An example of the specific measurement method will be described below.

Figure 2:
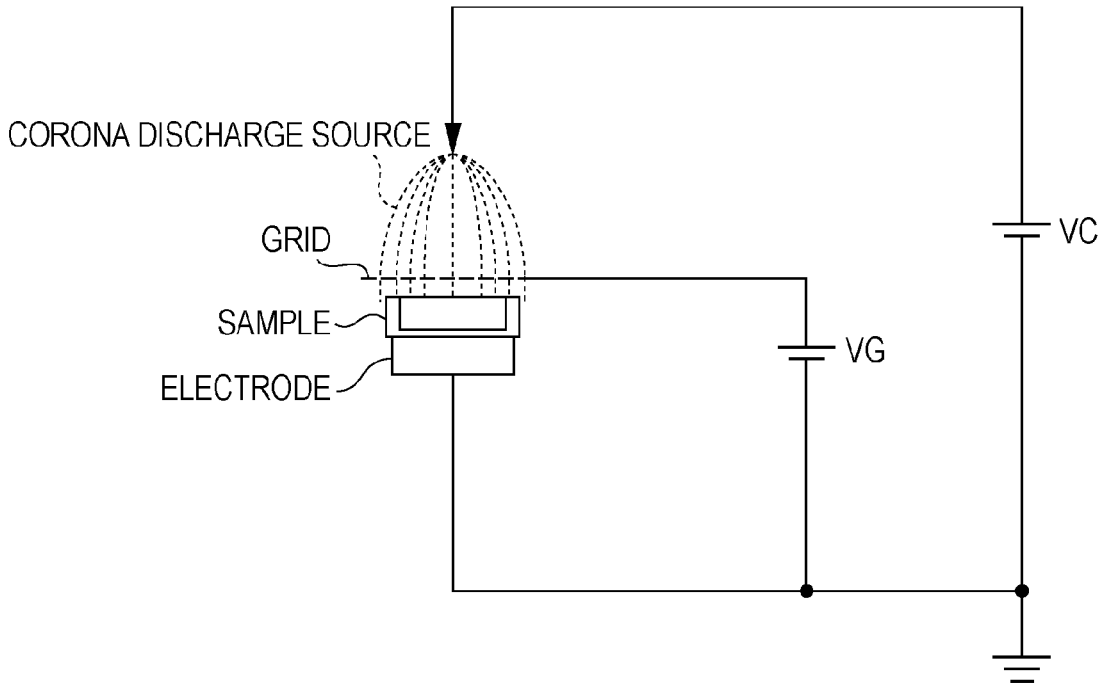
FIG. 2 is a schematic diagram of a charging device used for thermally stimulated current measurement.

A thermally stimulated current (TSC) is measured by a non-contact technique (2 mm), using a TS-FETT (manufactured by Rigaku Corporation). As a toner sample, the thermally stimulated current of which is to be measured, 1 g of a toner is left to stand under a normal temperature, normal humidity environment (temperature 23° C., humidity 60%) for 48 hours to control humidity. The toner sample (6 mg) is weighed and placed in a sample pan composed of aluminum (diameter 6 mm, depth 0.5 mm), and the surface of the sample is smoothed with a glass plate. Then, the sample pan is placed in a sample holder. Using a charging device shown in FIG. 2, a voltage is applied for 30 seconds to charge the sample to be measured under conditions of a grid voltage of 1 kV and a corona voltage of 20 kV.

Figure 3:
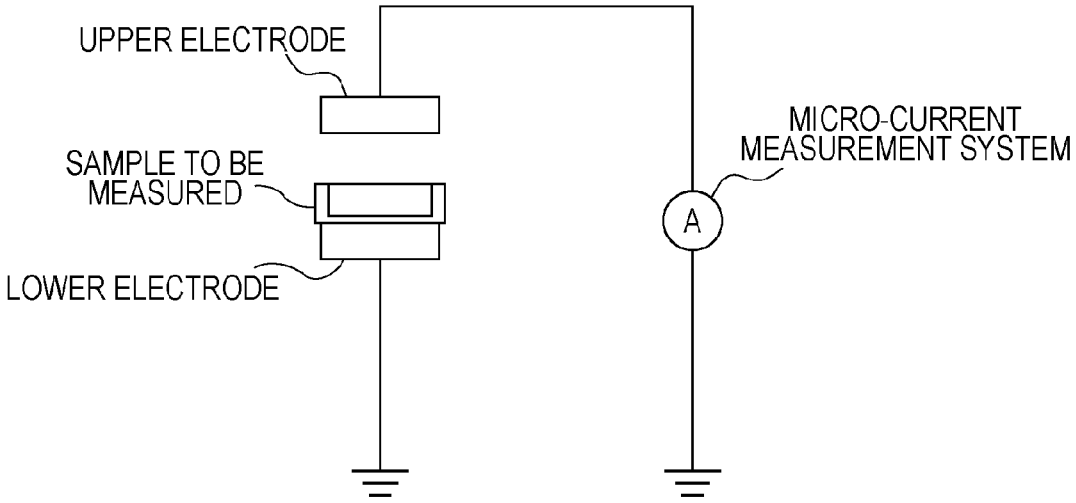
FIG. 3 is a schematic diagram of a thermally stimulated current measurement apparatus.

The TSC measurement apparatus has a structure shown in FIG. 3. The sample holder is set in the TS-FETT, and a current is measured while heating from 25° C. to 120° C. at a temperature rising rate of 1.5° C./min. By putting the current value measured on the vertical axis and the temperature on the horizontal axis, a thermally stimulated current spectrum is obtained. In the resulting thermally stimulated current spectrum, T0 (° C.) is defined as the temperature at MP which is a minimum value appearing on the highest temperature side among minimum values at a current value in a range of $-1.0\times10^{-13}$ A to $-1.0\times10^{-14}$ A. T1 (° C.) is defined as the temperature at which the current value is a quarter of MP and which is closest to T0 on the low temperature side from MP, and T2 (° C.) is defined as the temperature at which the current value is a quarter of MP and which is closest to T0 on the high temperature side from MP. Furthermore, S0 is defined as the area in the range of 40° C. to 120° C. of the thermally stimulated current spectrum, and S1 is defined as the area in the range of the temperature T1 to the temperature T0 of the thermally stimulated current spectrum.

The toner of the present invention includes a binder resin, a colorant, and a wax. Toner particles are preferably produced by a polymerization method, such as emulsion polymerization, dispersion polymerization, suspension polymerization, or seed polymerization, from the standpoint that the advantageous effects of the present invention are more fully exhibited. In particular, toner particles are more preferably produced by a suspension polymerization method.

As the binder resin, a known binder resin used for toner can be used. Examples of a polymerizable monomer for producing the binder resin include styrene-based monomers, acrylates, and methacrylates. These polymerizable monomers can be used alone or in combination. Among the polymerizable monomers described above, preferably, styrene or a styrene derivative is used alone or in combination with other polymerizable monomers to produce the binder resin in view of the developing characteristic and durability of the toner.

Furthermore, from the standpoint of improving the fixing performance of the toner, preferably, a resin component having a low molecular weight is present in the toner. In the case where toner particles are produced by a polymerization method, this can be achieved by adding a chain transfer agent or a crosslinking agent to control the molecular weight of the binder resin. Furthermore, this can also be achieved by producing a low molecular weight resin in advance and adding the low molecular weight resin to a polymerizable monomer composition to form toner particles. In the case where a low molecular weight resin is added, the weight-average molecular weight (Mw) of the low molecular weight resin is preferably 1500 to 8000, and more preferably 2500 to 5000. Furthermore, the amount of addition is preferably 1.0 to 50.0 parts by mass, and more preferably 5.0 to 20.0 parts by mass, relative to 100 parts by mass of the polymerizable monomer or the binder resin.

Examples of the colorant that can be used include black pigments, phthalocyanine pigments, mono-azo pigments, bis-azo pigments, and quinacridone pigments. Specific examples thereof include pigments, such as carbon black, chrome yellow, Hansa yellow, benzidine yellow, thren yellow, quinoline yellow, permanent orange GTR, pyrazolone orange, Balkan orange, permanent red, brilliant carmine 3B, brilliant carmine 6B, DuPont oil red, pyrazolone red, lithol red, Rhodamine B Lake, Lake Red C, Rose bengal, aniline blue, ultramarine blue, Calco oil blue, methylene blue chloride, phthalocyanine blue, phthalocyanine green, and malachite green oxalate. Furthermore, dyes may be used in combination with the above. Specific examples thereof include acridine dyes, xanthene dyes, azo dyes, benzoquinone dyes, azine dyes, anthraquinone dyes, dioxazine dyes, thiazine dyes, azomethine dyes, indigo dyes, thioindigo dyes, phthalocyanine dyes, aniline black dyes, polymethine dyes, triphenylmethane dyes, diphenylmethane dyes, thiazine dyes, thiazole dyes, and xanthene dyes. These colorants may be used alone or in combination of two or more.

Examples of the wax that can be used include petroleum waxes and derivatives thereof, such as paraffin wax and petrolatum; montan waxes and derivatives thereof; hydrocarbon waxes produced by a Fischer-Tropsch process, and derivatives thereof; polyethylene waxes and polypropylene waxes; and naturally occurring waxes such as carnauba wax and candelilla wax, and derivatives thereof. Other examples include higher aliphatic alcohols, fatty acids such as stearic acid and palmitic acid, or compounds thereof, acid amide waxes, ester waxes, ketones, hardened castor oil and derivatives thereof, vegetable waxes, and animal waxes. The wax is added preferably in an amount of 5.0 to 30.0 parts by mass, and more preferably in an amount of 5.0 to 15.0 parts by mass, relative to 100 parts by mass of the polymerizable monomer or the binder resin.

Furthermore, for the purpose of improving dispersibility of materials, fixing performance, or image characteristics, a resin may be incorporated into the toner particles. Examples of the resin that can be used include polymethyl methacrylate, polyethylene, silicone resins, polyester resins, and aliphatic or alicyclic hydrocarbon resins. These may be used alone or as a mixture of two or more. In particular, use of a polyester resin is preferable.

From the standpoint of controlling physical properties, such as chargeability, durability, and fixing performance, of the toner, a saturated polyester resin or an unsaturated polyester resin, or both, may be appropriately selected for use. The polyester resin is added preferably in an amount of 1.0 to 30.0 parts by mass relative to 100 parts by mass of the polymerizable monomer or the binder resin.

For the purpose of controlling chargeability of the toner, a charge-controlling agent may be incorporated into toner particles. When toner particles are produced by a polymerization method, it is preferable to use a charge-controlling agent substantially free from a polymerization-inhibiting property or transferability to aqueous phase. Examples of a positive charge-controlling agent include triphenylmethane dyes, quaternary ammonium salts, guanidine derivatives, imidazole derivatives, amine compounds, and nigrosine dyes. Examples of a negative charge-controlling agent include metal-containing salicylic acid copolymers, metal-containing mono-azo dye compounds, urea derivatives, styrene-acrylic acid copolymers, and styrene-methacrylic acid copolymers. These charge-controlling agents are preferably added in an amount of 0.1 to 10.0 parts by mass relative to 100 parts by mass of the polymerizable monomer or the binder resin.

Examples of a polymerization initiator to be used in the production of toner particles by a polymerization method include azo-based or diazo-based polymerization initiators, such as 2,2'-azobis-(2,4-dimethylvaleronitrile) and 2,2'-azobisisobutyronitrile; and peroxide-based polymerization initiators, such as benzoyl peroxide, t-hexyl peroxypivalate and t-butyl peroxypivalate.

When a toner is produced by a polymerization method, any known surfactants or organic or inorganic dispersants can be used as a dispersion stabilizer allowed to be present in an aqueous medium. Inorganic dispersants generally have a large size, and dispersion stability is obtained because of their steric hindrance. Thus, stability is not easily lost even if the reaction temperature is changed. Furthermore, they can be easily cleaned. Therefore, inorganic dispersants are more preferably used. Examples of the inorganic dispersants include phosphoric acid polyvalent metal salts, such as calcium phosphate and magnesium phosphate; carbonates, such as calcium carbonate and magnesium carbonate; inorganic salts, such as calcium metasilicate and barium sulfate; and inorganic oxides, such as calcium hydroxide, magnesium hydroxide, aluminum hydroxide, silica, and alumina. These inorganic dispersants may be used alone or may be used in combination with a surfactant in order to adjust the particle size distribution. Examples of the surfactant include sodium dodecylbenzenesulfate, sodium stearate, and potassium stearate. Furthermore, when an emulsion polymerization method is used, an anionic surfactant, a cationic surfactant, an amphoteric surfactant, or a nonionic surfactant is used.

In order to sufficiently broaden the thermally stimulated current spectrum in a specific range, it is effective to perform surface modification on toner particles. Examples of types of surface modification include acid treatment, alkali treatment, surfactant treatment, and oil treatment. Among these, two or more types of treatment may be performed. In particular, treatment with a surfactant is preferable as means for controlling the thermally stimulated current spectrum to the range specified in the present invention.

As the surfactant used in surface treatment, an anionic surfactant, a cationic surfactant, an amphoteric surfactant, or a nonionic surfactant can be used. A nonionic surfactant has in its molecule a hydrophilic moiety having high polarity and a hydrophobic moiety having no polarity, and exhibits surface active capability without being electrolyzed. Since a structure including a hydrophilic moiety and a hydrophobic moiety can be freely selected, the molecular structure can be relatively easily determined, and thus surface active capability can be easily controlled. Consequently, it is possible to select a product that has high environmental stability. Therefore, the nonionic surfactant is preferably used.

As the nonionic surfactant, a surfactant that has a polyoxyalkylene chain is preferable. By using such a surfactant, it is possible to obtain a toner having the thermally stimulated current spectrum specified in the present invention. The present inventors believe the reason for this is as follows.

The surface state of toner particles is largely involved in the thermally stimulated current spectrum, and surface modification greatly influences the thermally stimulated current spectrum. The reason for this is that the charged toner retains charges in surface layers of toner particles. When the toner is subjected to surface treatment with a surfactant, the surface of the toner becomes to have a low resistance in many cases. In particular, when a nonionic surfactant having a polyoxyalkylene chain is used, the orientation state of the surfactant changes depending on the magnitude of polarity. That is, since the surfactant is oriented in various ways depending on the magnitude of polarity in polar portions in the vicinity of surface layers of toner particles, the resistance broadens on the surface of toner. As a result, the thermally stimulated current spectrum of the toner broadens toward the low temperature side.

As the structure of the nonionic surfactant having a polyoxyalkylene chain, a polyoxyalkylene alkyl ether or a polyoxyalkylene alkyl ester is preferable. Specifically, the nonionic surfactant is preferably a compound represented by formula (1) or (2) below.

Formula (1)

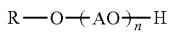

Formula (2)

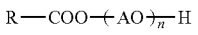

R: hydrogen or alkyl group having 8 to 30 carbon atoms

AO: oxyalkylene n: average number of addition moles

In the nonionic surfactant, the intensity and magnitude of the interaction with polar portions of surface layers of the toner can be controlled by the average number of addition moles of the alkylene oxide. The average number of addition moles n of the polyoxyalkylene chain is preferably 3 to 20, more preferably 5 to 15, and still more preferably 8 to 12.

Furthermore, more preferably, the nonionic surfactant is a polyoxyalkylene alkyl ether represented by formula (3) below.

Formula (3)

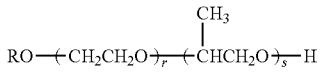

R: hydrogen or alkyl group having 8 to 30 carbon atoms

In formula (3) above, r represents the total number of addition moles of oxyethylene group, and s represents the total number of addition moles of oxypropylene group. The nonionic surfactant used in the present invention may have a structure in which polyoxyethylene blocks and polyoxypropylene blocks are alternately arranged, and in such a case, r and s each represents the sum of numbers of addition moles for the corresponding blocks. For example, when a compound shown by formula (4) below is represented by formula (3) above, r=10 and s=7.

Furthermore, the average number of addition moles n is calculated according to the equation n=r+s, and is preferably in the range described above. Furthermore, either one of r and s may be 0.

Formula (4)

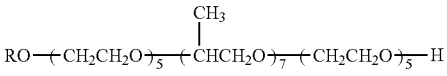

As the method of surface modification of toner particles by surfactant treatment, various methods are used, such as a method in which a surfactant is mixed into a dispersion liquid of toner particles, and a method in which a surfactant is dispersed in a highly volatile solvent, such as methanol, and then sprayed for mixing with a sprayer. In particular, in order to satisfy the characteristics of the thermally stimulated current specified in the present invention, preferably, treatment is performed by a method in which toner particles are dispersed in s solution obtained by dissolving a nonionic surfactant in water, a methanol aqueous solution, or the like. In this case, preferably, the nonionic surfactant is used in an amount of 0.01 to 5.0 parts by mass relative to 100 parts by mass of toner particles. When this method is used, the surfaces of toner particles are treated uniformly and sufficiently with the surfactant. On the other hand, in toner particles obtained by a kneading/pulverizing method, a spray dry method, or the like, a dispersion step of dispersing into a surfactant solution, a cleaning step of removing an excess surfactant, and a filtration/drying step, and the like make the process complicated.

In the case where toner particles are obtained by a production method in which granulation is performed in an aqueous medium, as the solid-liquid separation technique, any known technique, such as filtration, centrifugation, or decantation, may be used. Furthermore, in the method of washing toner particles, any method may be used. Preferably, a method in which washing is performed using a belt-type filer press or the like is used.

For the purpose of improving charging stability, development performance, fluidity, and durability, preferably, the toner includes an external additive. Examples of inorganic fine powder, as the external additive, include silica fine powder, alumina fine powder, and titanium oxide fine powder. In addition to inorganic fine powder, examples of the external additive include various resin fine particles and fatty acid metal salts. These may be used alone or in combination of two or more.

Preferably, fine powder of the external additive is, as necessary, treated with a surface treatment agent for the purpose of hydrophobization and chargeability control. Specific examples of the surface treatment agent include silicone varnish, various types of modified silicone varnish, silicone oil, various types of modified silicone oil, silane coupling agents, functional group-containing silane coupling agents, and other organosilicon compounds. These treatment agents may be used alone or in combination of two or more.

The external additive suitably used in the present invention has a specific surface area of 20 $m^2/g$ or more (particularly preferably 30 to 400 $m^2/g$), the specific surface area being measured by a BET method using nitrogen adsorption. The external additive is used preferably in an amount of 0.01 to 10.00 parts by mass, and more preferably in an amount of 0.10 to 5.00 parts by mass, relative to 100 parts by mass of the toner particles.

Furthermore, known lubricant powder may be added to the toner. Examples of the lubricant powder include fluorocarbon resins, such as polyvinylidene fluoride; fluorine compounds, such as carbon fluoride; fatty acid metal salts, such as zinc stearate; fatty acids and fatty acid derivatives, such as fatty acid esters; and molybdenum sulfide.

Furthermore, it is also preferable to add inorganic powder described below. Examples of the inorganic powder include oxides of metals, such as magnesium, zinc, aluminum, cerium, cobalt, iron, zirconium, chromium, manganese, strontium, tin, and antimony; composite metal oxides, such as calcium titanate, magnesium titanate, and strontium titanate; metal salts, such as calcium carbonate, magnesium carbonate, and aluminum carbonate; clay minerals, such as kaolin; phosphoric acid compounds, such as apatite; silicon compounds, such as silicon carbide and silicon nitride; and carbon powder, such as carbon black and graphite. Furthermore, the toner of the present invention can be used for either a single-component developer or a two-component developer.

EXAMPLES

The present invention will be described more specifically below by way of examples. Unless otherwise specified, in examples and comparative examples, "part(s)" represents "part(s) by mass" and "%" represents "% bymass".

<Production Example of Charge-Controlling Resin>

In a pressurizable reaction container equipped with a reflux tube, a stirrer, a thermometer, a nitrogen introduction tube, a dropping device, and a pressure reduction device, 250 parts by mass of methanol, 150 parts by mass of 2-butanone, and 100 parts by mass of 2-propanol were added as solvents, and 80 parts by mass of styrene, 15 parts by mass of 2-ethylhexyl acrylate, and 10 parts by mass of 2-acrylamide-2-methylpropanesulfonic acid were added as monomers, followed by heating under stirring to a reflux temperature. A solution prepared by diluting 1 part by mass of t-butylperoxy-2-ethyl hexanoate, as a polymerization initiator, with 20 parts by mass of 2-butanone was added dropwise thereto over 30 minutes. Then, stirring was continued for 5 hours, and a solution prepared by diluting 1 part by mass of t-butylperoxy-2-ethyl hexanoate with 20 parts by mass of 2-butanone was further added dropwise thereto, followed by stirring for 5 hours to complete polymerization. While maintaining the temperature, 500 parts by mass of deionized water was added thereto, and the resulting mixture was stirred for 2 hours at 80 to 100 rpm so as not to disrupt the interface between the organic layer and the aqueous layer, and was left to stand for one hour to separate the layers. Subsequently, the aqueous layer was discarded, and anhydrous sodium sulfate was added to the organic layer to dehydrate the organic layer.

Next, a polymer obtained after distilling off the polymerization solvent under reduced pressure was roughly pulverized into particles of 100 μm or less with a cutter mill equipped with a 150-mesh screen. In the resulting sulfur atom-containing charge-controlling resin, Tg=60° C., Mp=12000, and Mw=30000.

Production Example of Toner

Example 1

Relative to 100 parts by mass of styrene monomer, 25 parts by mass of C.I. Pigment Blue 15:3 and 2.0 parts by mass of a 3,5-di-tert-butylsalicylic acid aluminum compound [BONTRON E88 (manufactured by Orient Chemical Industries, Ltd.)] were prepared. These materials were introduced into an attritor (manufactured by Mitsui Mining Co., Ltd.), and, using zirconia beads with a radius of 1.25 mm (140 parts by mass), stirring was performed at 200 rpm, at 25° C. for 300 minutes to prepare a master batch dispersion liquid.

Meanwhile, 285 parts by mass of a 0.1 mol/l-$Na_3PO_4$ aqueous solution was added into 450 parts by mass of ion-exchanged water, followed by heating to 60° C. Then, 15 parts by mass of a 1.0 mol/l-$CaCl_2$ aqueous solution was gradually added thereto to obtain an aqueous medium containing a calcium phosphate compound.

| | |
|---|---|
| Master batch dispersion liquid | 25 parts by mass |
| Styrene monomer | 40 parts by mass |
| n-butyl acrylate monomer | 28 parts by mass |
| Low-molecular-weight polystyrene (Mw = 3000, Mn = 1050, Tg = 55° C.) | 15 parts by mass |
| Hydrocarbon wax (Fischer-Tropsch wax HNP-51 (Nippon Seiro Co., Ltd.), peak temperature of maximum endothermic peak = 78° C.) | 7 parts by mass |
| Polyester resin (polycondensate of terephthalic acid:isophthalic acid:propylene oxide-modified bisphenol A (2 mole adduct):ethylene oxide-modified bisphenol A (2 mole adduct) = 30:30:30:10, acid value 11, Tg = 74° C., Mw = 11000, Mn = 4000) | 7.5 parts by mass |
| Charge-controlling resin (described above) | 1.5 parts by mass |

The above-described materials were heated to 65° C. and uniformly dissolved and dispersed, using a TK-type homomixer (manufactured by Tokushu Kikakogyo) at 5,000 rpm. In the resulting mixture, 8 parts by mass of a 70% toluene solution of polymerization initiator 1,1,3,3-tetramethylbutylperoxy-2-ethyl hexanoate was dissolved. Thereby, a polymerizable monomer composition was prepared. The polymerizable monomer composition was added into the aqueous medium, followed by stirring at 65° C. in an atmosphere of $N_2$ for 10 minutes, using a TK-type homomixer at 12,000 rpm, to granulate the polymerizable monomer composition. Then, the temperature was raised to 67° C. while stirring with a paddle agitating blade, and when the polymerization conversion of the polymerizable vinyl monomer reached 90%, a 0.1 mol/l aqueous sodium hydroxide solution was added so as to adjust the pH of the aqueous dispersion medium to 9. The temperature was further raised to 80° C. at a temperature raising rate of 40° C./h, and the reaction was carried out for 5 hours. After the polymerization reaction was completed, the monomer remaining in the resulting particles was removed by distillation under reduced pressure. The aqueous medium was cooled, and thereby, a dispersion liquid of polymer particles was obtained.

Then, hydrochloric acid was added to the dispersion liquid of polymer particles so as to adjust the pH to 1.4, and stirring was performed for one hour to dissolve the calcium phosphate salt.

A surface treatment liquid prepared by dissolving 0.20 parts by mass of polyoxyethylene(10) lauryl ether (manufactured by Wako Pure Chemical Industries, Ltd.) in 10 parts by mass of ion-exchanged water was added to the dispersion liquid of polymer particle, followed by stirring for one hour to perform surface treatment on the polymer particles.

The dispersion liquid was subjected to solid-liquid separation with a pressure filter under a pressure of 0.4 Mpa to obtain a toner cake. Then, ion-exchanged water was added to fill the pressure filter to a high water level, and washing was performed at a pressure of 0.4 Mpa. The washing operation was repeated once, and then drying was performed. 1.5 Parts by mass of hydrophobic silica fine powder (number-average primary particle diameter: 10 nm) surface-treated with hexamethyldisilazane was added to the dried product, and using a Henschel mixer (manufactured by Mitsui Mining Co., Ltd.), a mixing step was carried out for 300 seconds. Thereby, Toner 1 was obtained. Table 1 shows addition amounts, etc. of the low-molecular-weight polystyrene, polyester, wax, charge-controlling resin, and surface treatment liquid.

A thermally stimulated current spectrum of Toner 1 was measured, and T0–T1, T2–T0, MP, T0, and S1/S0 were obtained. The measurement results are shown in Table 2. Furthermore, using Toner 1, image evaluation was performed as described below. The evaluation results are shown in Table 3.

<Image Evaluation>

Image evaluation was performed using a commercially available color laser printer HP Color LaserJet 2025dn (manufactured by HP Company) which had been partially modified. In the modification, the process speed was changed to 150 mm/sec, and the printer was modified such that it could operate when only one color process cartridge was mounted thereon.

Figure 4:
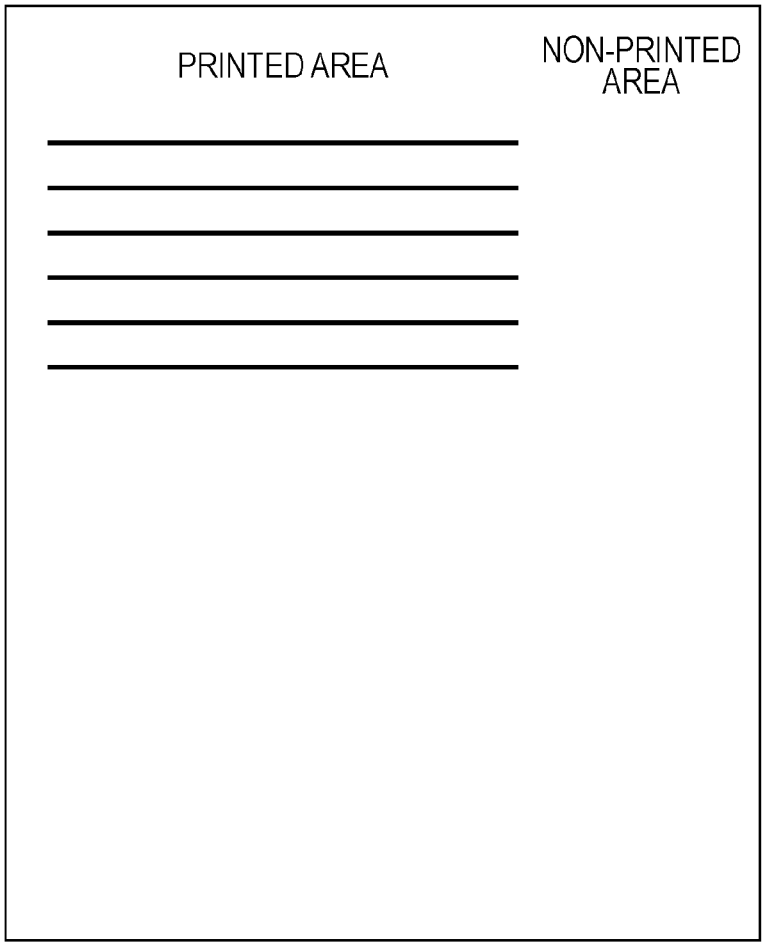
FIG. 4 is a schematic view showing an image consisting of horizontal lines at a coverage rate of 1%.

From a commercially available black cartridge, a toner held therein was removed. After the interior of the cartridge was cleaned by air blowing, the test toner (100 g) and a toner supporting member were placed in the cartridge. Using this cartridge, development performance and durability were evaluated under a low-temperature, low-humidity environment (15° C., 10% RH) and under a high-temperature, high-humidity environment (30° C., 80% RH). Image evaluation items are described below. The image evaluation was performed after an image including horizontal lines and having a coverage rate of 1%, as shown in FIG. 4, was printed on 5,000 sheets. In this case, as the transfer medium, LETTER size XEROX 4200 paper (manufactured by XEROX Corporation, 75 g/$m^2$) was used.

[Development Streaks]

After printing test of 5,000 sheets was completed, a halftone image (toner load: 0.3 mg/$cm^2$) was printed on a transfer sheet, and evaluation was made on the basis of the number of development streaks. As the transfer medium, A4 size CLC paper (manufactured by CANON KABUSHIKI KAISHA, 80 g/$m^2$) was used.

A: No development streaks occurred under each of low-temperature, low-humidity environment and high-temperature, high humidity environment.

B: One to three development streaks occurred either under low-temperature, low-humidity environment or under high-temperature, high humidity environment.

C: Four to six development streaks occurred either under low-temperature, low-humidity environment or under high-temperature, high humidity environment.

D: Seven or more development streaks occurred either under low-temperature, low-humidity environment or under high-temperature, high humidity environment.

[Fogging]

After printing test of 5,000 sheets was completed, the reflectance (%) of the non-image area of the printed image was measured with a "REFLECTOMETER MODEL TC-6DS" (manufactured by Tokyo Denshoku Co., Ltd). Evaluation was made using a numerical value (%) obtained by subtracting the measured reflectance from the reflectance (%) of an unused printing sheet (standard paper) measured in the same manner. A smaller numerical value indicates that fogging is more suppressed. As the transfer medium, A4 size CLC paper (manufactured by CANON KABUSHIKI KAISHA, 80 g/m$^2$) was used.

A: Less than 0.5

B: 0.5 or more and less than 1.5

C: 1.5 or more and less than 3.0

D: 3.0 or more

[Filming]

After printing test of 5,000 sheets was completed, a half-tone image (toner load: 0.3 mg/cm$^2$) was printed on a transfer medium. In the half-tone image, between the 1% printed image area and the non-printed image area, occurrence of uneven shading was visually evaluated. Then, air was blown onto the surface of the toner supporting member, and the surface of the toner supporting member was observed. As the transfer medium, A4 size CLC paper (manufactured by CANON KABUSHIKI KAISHA, 80 g/m$^2$) was used.

A: No uneven shading occurs on the image, and the surface of the toner supporting member is satisfactory.

B: No uneven shading occurs on the image, but filming is observed on the surface of the toner supporting member.

C: Slight uneven shading occurs on the image.

D: Uneven shading occurs markedly on the image.

[Image Density Stability]

After printing test of 5,000 sheets was completed, a solid image was printed continuously on three sheets, and the difference in image density between the first sheet and the third sheet was evaluated. In the measurement of image density, using a "Macbeth reflection density meter RD918" (manufactured by Macbeth Corporation), the relative density with respect to a print-out image of a white area with a manuscript density of 0.00 was measured. As the transfer medium, A4 size CLC paper (manufactured by CANON KABUSHIKI KAISHA, 80 g/m$^2$) was used.

A: Less than 0.05 under each of low-temperature, low-humidity environment and high-temperature, high humidity environment.

B: Larger relative density of 0.05 or more and less than 0.10 either under low-temperature, low-humidity environment or under high-temperature, high humidity environment.

C: Larger relative density of 0.10 or more and less than 0.15 either under low-temperature, low-humidity environment or under high-temperature, high humidity environment.

D: Larger relative density of 0.15 or more either under low-temperature, low-humidity environment or under high-temperature, high humidity environment.

Examples 2 to 24

Toners 2 to 24 were obtained as in Toner 1 except that, in the production method of Toner 1, the number of parts of low-molecular-weight polystyrene added, the number of parts of polyester added, the type and number of parts of wax added, the number of parts of charge-controlling resin added, and the number of parts of surface treatment liquid added were set as those shown in Table 1.

The analysis results of thermally stimulated current spectra of Toners 2 to 24 are shown in Table 2. Furthermore, using Toners 2 to 24, image evaluation was performed as in Toner 1. The evaluation results are shown in Table 3.

Comparative Examples 1 to 5

Toners 25 to 29 were obtained as in Toner 1 except that, in the production method of Toner 1, the number of parts of low-molecular-weight polystyrene added, the number of parts of polyester added, the type and number of parts of wax added, and the number of parts of charge-controlling resin added were set as those shown in Table 1.

The analysis results of thermally stimulated current spectra of Toners 25 to 29 are shown in Table 2. Furthermore, using Toners 25 to 29, image evaluation was performed as in Toner 1. The evaluation results are shown in Table 3.

TABLE 1

| | Low-molecular-weight polystyrene | | | Polyester | Wax | | | Charge-controlling resin | Surface treatment agent | |
|---|---|---|---|---|---|---|---|---|---|---|
| | Mw | Mn | Addition amount (parts by mass) | Addition amount (parts by mass) | Name*1 | Melting point (° C.) | Addition amount (parts by mass) | Addition amount (parts by mass) | Name*2 | Treatment amount (parts by mass) |
| Toner 1 | 3000 | 1050 | 15 | 7.5 | HNP-51 | 77 | 7 | 1.5 | POE(10)laurate | 0.2 |
| Toner 2 | 3000 | 1050 | 15 | 10.0 | HNP-51 | 77 | 7 | 1.5 | POE(10)laurate | 0.2 |
| Toner 3 | 3000 | 1050 | 10 | 7.5 | HNP-51 | 77 | 7 | 1.5 | POE(10)laurate | 0.2 |
| Toner 4 | 3000 | 1050 | 10 | 10.0 | HNP-51 | 77 | 7 | 1.5 | POE(10)laurate | 0.2 |
| Toner 5 | 3000 | 1050 | 15 | 7.5 | HNP-51 | 77 | 7 | 1.5 | POE(10)laurate | 0.5 |
| Toner 6 | 3000 | 1050 | 15 | 7.5 | HNP-51 | 77 | 10 | 1.5 | POE(10)laurate | 0.2 |
| Toner 7 | 3000 | 1050 | 15 | 7.5 | PE-16 | 69 | 7 | 1.5 | POE(10)laurate | 0.2 |
| Toner 8 | 3000 | 1050 | 20 | 7.5 | PE-16 | 69 | 7 | 1.5 | POE(10)laurate | 0.2 |
| Toner 9 | 3000 | 1050 | 20 | 7.5 | HNP-51 | 77 | 7 | 1.5 | POE(10)laurate | 0.5 |

TABLE 1-continued

| | Low-molecular-weight polystyrene | | | Polyester | Wax | | | Charge-controlling resin | Surface treatment agent | |
|---|---|---|---|---|---|---|---|---|---|---|
| | Mw | Mn | Addition amount (parts by mass) | Addition amount (parts by mass) | Name*1 | Melting point (° C.) | Addition amount (parts by mass) | Addition amount (parts by mass) | Name*2 | Treatment amount (parts by mass) |
| Toner 10 | 4200 | 1650 | 15 | 7.5 | C105 | 105 | 10 | 1.5 | POE(10)laurate | 0.2 |
| Toner 11 | 4200 | 1650 | 15 | 7.5 | C105 | 105 | 7 | 1.5 | POE(10)laurate | 0.2 |
| Toner 12 | 3000 | 1050 | 20 | 7.5 | PE-16 | 69 | 7 | 2.0 | POE(10)laurate | 0.01 |
| Toner 13 | 5400 | 2100 | 25 | 7.5 | PW655 | 92 | 7 | 1.5 | POE(10)laurate | 0.2 |
| Toner 14 | 5400 | 2100 | 30 | 7.5 | PW655 | 92 | 7 | 1.5 | POE(10)laurate | 0.2 |
| Toner 15 | 3000 | 1050 | 20 | 7.5 | PE-16 | 69 | 7 | 1.5 | POE(10)laurate | 0.01 |
| Toner 16 | 4200 | 1650 | 7.5 | 7.5 | C105 | 105 | 7 | 1.5 | POE(10)laurate | 0.2 |
| Toner 17 | 5400 | 2100 | 25 | 7.5 | HNP-51 | 77 | 7 | 1.5 | POE(10)laurate | 0.5 |
| Toner 18 | 5400 | 2100 | 20 | 5.0 | PE-16 | 69 | 7 | 1.5 | POE(10)laurate | 0.01 |
| Toner 19 | 3000 | 1050 | 15 | 7.5 | PW1000 | 110 | 7 | 1.5 | POE(10)laurate | 0.2 |
| Toner 20 | 5400 | 2100 | 25 | 7.5 | Carnauba | 82 | 7 | 0.5 | POE(10)laurate | 0.5 |
| Toner 21 | 3000 | 1050 | 15 | 7.5 | HNP-51 | 77 | 3 | 2.0 | POE(10)laurate | 0.1 |
| Toner 22 | 4200 | 1650 | 30 | 7.5 | HNP-51 | 77 | 20 | 1.0 | POE(10)laurate | 0.5 |
| Toner 23 | 3000 | 1050 | 15 | 7.5 | HNP-51 | 77 | 7 | 1.5 | POE(4)stearate | 1.0 |
| Toner 24 | 3000 | 1050 | 15 | 7.5 | HNP-51 | 77 | 7 | 1.5 | POE(20)stearate | 0.1 |
| Toner 25 | 3000 | 1050 | 15 | 5.0 | PE-16 | 69 | 7 | 1.5 | — | — |
| Toner 26 | 3000 | 1050 | 50 | 7.5 | HNP-51 | 77 | 7 | 3.0 | — | — |
| Toner 27 | 4200 | 1650 | 30 | 7.5 | PE-16 | 69 | 7 | 1.5 | — | — |
| Toner 28 | 4200 | 1650 | 50 | 7.5 | Carnauba | 82 | 7 | — | — | — |
| Toner 29 | 5400 | 2100 | 10 | 7.5 | PE-16 | 69 | 7 | 2.5 | — | — |

*1HNP-51 Hydrocarbon wax (Fischer-Tropsch wax): manufactured by Nippon Seiro Co., Ltd. PE-16 Ester wax (pentaerythritol palmitate): manufactured by Nisshin Oilio Group, Ltd. C105 Hydrocarbon wax (Fischer-Tropsch wax): manufactured by Sasol Corp. PW655 Hydrocarbon wax (polyethylene wax): manufactured by Toyo Petrolite Co., Ltd. PW1000 Hydrocarbon wax (polyethylene wax): manufactured by Toyo Petrolite Co., Ltd. Carnauba Ester wax (Carnauba Wax No. 1): manufactured by Nippon Wax Co., Ltd.
*2POE(10)laurate (polyoxyethylene(10) lauryl ether): manufactured by Wako Pure Chemical Industries, Ltd. POE(4)stearate (polyoxyethylene(4) stearyl ether): manufactured by Wako Pure Chemical Industries, Ltd. POE(20)stearate (polyoxyethylene(20) stearyl ether): manufactured by Wako Pure Chemical Industries, Ltd.
Number in parentheses represents average number of addition moles of ethylene oxide.

TABLE 2

| | Thermally stimulated current data | | | | |
|---|---|---|---|---|---|
| | T0 − T1 (° C.) | T2 − T0 (° C.) | MP ($\times 10^{-13}$ A) | T0 (° C.) | S1/S0 |
| Toner 1 | 16.0 | 4.6 | −0.55 | 78 | 0.65 |
| Toner 2 | 14.8 | 4.1 | −0.72 | 72 | 0.73 |
| Toner 3 | 14.1 | 5.1 | −0.63 | 77 | 0.61 |
| Toner 4 | 13.8 | 2.9 | −0.76 | 71 | 0.76 |
| Toner 5 | 19.3 | 3.1 | −0.42 | 78 | 0.84 |
| Toner 6 | 14.3 | 5.7 | −0.67 | 77 | 0.57 |
| Toner 7 | 13.1 | 10.5 | −0.43 | 66 | 0.41 |
| Toner 8 | 13.7 | 14.8 | −0.47 | 67 | 0.37 |
| Toner 9 | 19.7 | 3.4 | −0.41 | 76 | 0.86 |
| Toner 10 | 13.1 | 3.9 | −0.31 | 105 | 0.22 |
| Toner 11 | 13.3 | 4.8 | −0.28 | 106 | 0.18 |
| Toner 12 | 7.7 | 5.2 | −0.97 | 67 | 0.36 |
| Toner 13 | 24.5 | 14.1 | −0.28 | 90 | 0.53 |
| Toner 14 | 29.3 | 13.6 | −0.23 | 93 | 0.61 |
| Toner 15 | 7.9 | 5.8 | −0.93 | 68 | 0.32 |

TABLE 2-continued

| | Thermally stimulated current data | | | | |
|---|---|---|---|---|---|
| | T0 − T1 (° C.) | T2 − T0 (° C.) | MP ($\times 10^{-13}$ A) | T0 (° C.) | S1/S0 |
| Toner 16 | 12.7 | 4.2 | −0.25 | 108 | 0.21 |
| Toner 17 | 21.0 | 3.0 | −0.38 | 79 | 0.88 |
| Toner 18 | 8.3 | 4.3 | −0.94 | 64 | 0.41 |
| Toner 19 | 16.0 | 4.9 | −0.21 | 114 | 0.19 |
| Toner 20 | 26.7 | 14.3 | −0.13 | 82 | 0.88 |
| Toner 21 | 25.0 | 9.7 | −0.31 | 79 | 0.68 |
| Toner 22 | 13.4 | 2.1 | −0.85 | 74 | 0.64 |
| Toner 23 | 18.3 | 5.2 | −0.31 | 77 | 0.71 |
| Toner 24 | 23.4 | 5.8 | −0.43 | 79 | 0.81 |
| Toner 25 | 7.4 | 3.2 | −0.88 | 63 | 0.38 |
| Toner 26 | 31.0 | 14.8 | −0.73 | 77 | 0.63 |
| Toner 27 | 14.8 | 15.4 | −0.51 | 69 | 0.42 |
| Toner 28 | 24.0 | 13.8 | −0.09 | 81 | 0.91 |
| Toner 29 | 7.9 | 2.9 | −1.08 | 69 | 0.34 |

TABLE 3

| | | Development streaks (L/L, H/H) | Fogging (L/L) | Fogging (H/H) | Filming | Density stability (L/L, H/H) |
|---|---|---|---|---|---|---|
| Example 1 | Toner 1 | A(0, 0) | A(0) | A(0) | A | A(0, 0) |
| Example 2 | Toner 2 | A(0, 0) | A(0) | A(0.1) | A | A(0, 0) |
| Example 3 | Toner 3 | A(0, 0) | A(0.1) | A(0.1) | B | A(0, 0.01) |
| Example 4 | Toner 4 | A(0, 0) | A(0.1) | B(0.6) | A | A(0.01, 0.01) |
| Example 5 | Toner 5 | A(0, 0) | A(0) | B(0.5) | A | A(0.01, 0.03) |
| Example 6 | Toner 6 | A(0, 0) | A(0.1) | A(0.3) | B | A(0.01, 0.02) |
| Example 7 | Toner 7 | A(0, 0) | A(0.2) | B(0.7) | B | B(0.03, 0.05) |
| Example 8 | Toner 8 | A(0, 0) | A(0.1) | B(0.6) | B | B(0.03, 0.06) |
| Example 9 | Toner 9 | A(0, 0) | A(0.1) | B(0.7) | A | A(0.02, 0.02) |
| Example 10 | Toner 10 | A(0, 0) | B(0.7) | B(0.7) | B | A(0.02, 0.02) |

TABLE 3-continued

| | | Development streaks (L/L, H/H) | Fogging (L/L) | Fogging (H/H) | Filming | Density stability (L/L, H/H) |
|---|---|---|---|---|---|---|
| Example 11 | Toner 11 | A(0, 0) | B(1.0) | B(1.0) | B | B(0.05, 0.06) |
| Example 12 | Toner 12 | B(1, 0) | A(0.2) | C(1.7) | C | A(0.02, 0.03) |
| Example 13 | Toner 13 | A(0, 0) | A(0.3) | C(1.7) | B | B(0.05, 0.05) |
| Example 14 | Toner 14 | A(0, 0) | A(0.2) | B(1.3) | C | B(0.04, 0.07) |
| Example 15 | Toner 15 | B(0.1) | A(0.3) | C(2.0) | C | B(0.06, 0.04) |
| Example 16 | Toner 16 | B(1, 0) | C(1.8) | B(1.3) | A | B(0.06, 0.03) |
| Example 17 | Toner 17 | A(0, 0) | B(1.0) | C(1.9) | B | B(0.07, 0.06) |
| Example 18 | Toner 18 | B(1, 1) | A(0.3) | B(1.2) | C | A(0.03, 0.04) |
| Example 19 | Toner 19 | A(0, 0) | B(1.3) | C(2.0) | B | A(0.02, 0.03) |
| Example 20 | Toner 20 | A(0, 0) | A(0.3) | C(1.8) | C | B(0.06, 0.06) |
| Example 21 | Toner 21 | A(0, 0) | B(1.3) | C(1.9) | C | A(0.04, 0.03) |
| Example 22 | Toner 22 | A(0, 0) | A(0.4) | C(1.9) | B | A(0.04, 0.04) |
| Example 23 | Toner 23 | A(0, 0) | A(0.4) | B(1.3) | C | A(0.04, 0.04) |
| Example 24 | Toner 24 | B(1, 2) | A(0.4) | C(2.0) | B | B(0.06, 0.08) |
| Comparative Example 1 | Toner 25 | D(7, 6) | B(1.3) | C(2.8) | C | B(0.08, 0.09) |
| Comparative Example 2 | Toner 26 | B(1, 1) | A(0.4) | D(3.3) | C | C(0.09, 0.11) |
| Comparative Example 3 | Toner 27 | B(1, 2) | B(0.7) | B(1.4) | D | B(0.08, 0.07) |
| Comparative Example 4 | Toner 28 | D(7, 9) | B(1.4) | D(3.5) | B | C(0.12, 0.14) |
| Comparative Example 5 | Toner 29 | D(9, 9) | C(2.7) | B(1.3) | D | C(0.08, 0.11) |

In a toner which has a thermally stimulated current spectrum shape defined in the present invention, a stable and excellent charging characteristic, which is not easily influenced by the environment, is exhibited, and high image quality can be achieved for a long period of time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Application No. PCT/JP2009/068436, filed Oct. 27, 2009, hereby incorporated by reference herein in its entirety.

The invention claimed is:

1. A toner comprising toner particles including a binder resin, a colorant, and a wax, wherein, when measuring a sample prepared by leaving the toner to stand at a temperature of 23° C. and at a humidity of 60% for forty-eight hours, with a thermally stimulated current measurement apparatus, the toner satisfies the following relationship derived from the thermally stimulated current spectrum:

T0 is 65° C. or more and 110° C. or less the difference T0−T1 is 7.5° C. or more and 30.0° C. or less, and the difference T2−T0 is more than 0° C. and 15.0° C. or less, where T0 (° C.) is the temperature at MP which is a minimum value appearing on the highest temperature side among minimum values at a current value in a range of $-1.0\times10^{-13}$ A to $-1.0\times10^{-14}$ A, T1 (° C.) is the temperature at which the current value is a quarter of MP and which is closest to T0 on the low temperature side, and T2 (° C.) is the temperature at which the current value is a quarter of MP and which is closest to T0 on the high temperature side.

2. The toner according to claim 1, wherein the difference T0−T1 is 13.0° C. or more and 20.0° C. or less.

3. The toner according to claim 1, wherein S1/S0 is 0.35 or more and 0.85 or less, where S0 is the area of the thermally stimulated current spectrum, and S1 is the area in the range of the T1 to the T0.

* * * * *